US008870294B2

(12) United States Patent
Mankin

(10) Patent No.: US 8,870,294 B2
(45) **Date of Patent: *Oct. 28, 2014**

(54) COLLAPSIBLE CHAIR

(71) Applicant: Balanced Body, Inc., Sacramento, CA (US)

(72) Inventor: Maria G. Mankin, Point Reyes Station, CA (US)

(73) Assignee: Balanced Body, Inc., Sacramento, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/244,116

(22) Filed: Apr. 3, 2014

(65) Prior Publication Data

US 2014/0210248 A1 Jul. 31, 2014

Related U.S. Application Data

(63) Continuation of application No. 13/600,000, filed on Aug. 30, 2012, now Pat. No. 8,721,005.

(60) Provisional application No. 61/573,463, filed on Sep. 6, 2011.

(51) Int. Cl.

| | |
|---|---|
| ***A47C 4/02*** | (2006.01) |
| ***A47C 4/00*** | (2006.01) |
| ***A47C 7/46*** | (2006.01) |

(52) U.S. Cl.

CPC .... *A47C 4/00* (2013.01); *A47C 7/46* (2013.01)
USPC ..... 297/452.41; 297/44; 297/440.13

(58) Field of Classification Search

USPC ..... 297/16.1, 42, 44, 59, 440.1, 440.12, 297/440.13, 451.3, 452.41
See application file for complete search history.

(56) References Cited

U.S. PATENT DOCUMENTS

| | | | | |
|---|---|---|---|---|
| 484,240 | A * | 10/1892 | Rieckert | 297/44 |
| 3,365,258 | A * | 1/1968 | Downing | 312/140.2 |
| 5,605,378 | A * | 2/1997 | Oyediran | 297/440.13 |
| 5,690,389 | A * | 11/1997 | Ekman et al. | 297/452.41 |
| 6,070,943 | A * | 6/2000 | Guery-Strahm | 297/452.41 |
| 6,247,754 | B1 * | 6/2001 | Vanderaue et al. | 297/440.13 |
| 6,702,388 | B1 * | 3/2004 | Chiu | 297/452.41 |
| 7,017,996 | B2 * | 3/2006 | Peterson | 297/440.13 |
| 7,044,558 | B2 * | 5/2006 | Chiu | 297/452.41 |
| 7,588,522 | B2 * | 9/2009 | Heitzman | 297/452.41 |

* cited by examiner

*Primary Examiner* — Peter Brown
(74) *Attorney, Agent, or Firm* — Greenberg Traurig, LLP

(57) ABSTRACT

A collapsible chair includes a frame having two sidepieces, each having a base portion and a back portion. The base has an upward facing concave edge complementary to a portion of a spherical profile of a seating ball, the base portion further includes a frontal aspect. Each sidepiece has one or more hinges to connect the two sidepieces. The sidepieces, when hinged together, are moveable between a collapsed arrangement and an open arrangement. The chair further includes a cross member having an upward facing concave edge complementary to a portion of the spherical profile of the seating ball. The cross member is configured to mate with the frontal aspects of the two sidepieces so as to stabilize the two sidepieces in the open position. The upward facing concave edges of the sidepieces and the cross member form a triangular cradle that supports the seating ball.

20 Claims, 11 Drawing Sheets

COLLAPSIBLE CHAIR

CROSS-REFERENCE TO RELATED APPLICATIONS

This application is a continuation of U.S. patent application Ser. No. 13/600,000 filed Aug. 30, 2012 which claims priority to U.S. Provisional Patent Application No. 61/573,463 of Mankin, entitled "Collapsible Chair", as filed on Sep. 6, 2011.

TECHNICAL FIELD OF THE TECHNOLOGY

The present invention relates to a collapsible chair suitable for use in the office, at home, or as an exercise workstation.

INCORPORATION BY REFERENCE

All publications and patent applications mentioned in this specification are herein incorporated by reference to the same extent as if each such individual publication or patent application were specifically and individually indicated to be so incorporated by reference.

BACKGROUND

Exercise studios, such as a Pilates studio, and physical therapy studios make use of a wide variety of equipment and devices. Floor space in such studios, as well as in home settings is at a premium. It is generally desirable that studio equipment has flexibility of use, and that it is easily handled, is portable, and can be stored in a manner that is occupies a minimal amount of floor space or volume. There is further a need for equipment that is particularly suitable for the senior demographic, or for people with disabilities or injuries. The invention, as disclosed herein, a collapsible chair suitable for exercise and general home and office use, is responsive to these various demands in the market place.

SUMMARY OF THE DISCLOSURE

Embodiments of the technology provide embodiments of a collapsible or foldable ergonomic chair suitable for a working environment, home environment, or as an exercise platform. Ergonomic features include a seating ball and a lumbar support ball, each ball supported in a cradle or receptacle. The position of the lumbar support ball relative to the seating ball provides ergonomic benefits in that the lumbar support ball, within the structural context of embodiments of the chair as a whole, is configured to encourage a subject sitting on the chair to maintain a posture with his or her spine in a neutral position. Further, the lumbar support ball is positioned to provide support to the spine when it is in a neutral position. The neutral spine position is optimal for overall postural stability, opening the chest, and balancing the strength of back muscles, abdominal muscles, and deeper core muscles. The neutral spine position is further appropriate for any activity a subject may be engaged in while sitting on an embodiment of the chair, such as when a subject is working at a desk, engaging in conversation or any seated activity, or performing exercises such as Pilates style movements.

Embodiments of the chair include a collapsible frame having two hinged substantially flat chair sidepieces and a cross member. In some embodiments of the chair, the sidepieces are substantially mirror images of each other. Each sidepiece has an internal face and an external face, and each sidepiece has a base portion and a back portion. The base portion includes an upward facing concave edge, the concave edge being complementary to a portion of a spherical profile of a seating ball, and a frontal aspect. The back portion includes a back edge and a hole in its upper region. In some embodiments, the hole in the upper region of a sidepiece may be shaped liked a wedge or an inverted teardrop, i.e., vertically elongate, relatively wide at the top and relatively narrow at the bottom. Embodiments of the chair's sidepieces may further include one or more hinge attachment sites configured to connect the two sidepieces at their respective back edges. Embodiments of the sidepieces, when connected by hinges in place at the hinge attachment sites, are moveable between a collapsed arrangement, suitable for storage or transport of the chair, and an open or working arrangement in which the chair can accommodate a seating ball, and the ball, in turn, can support a subject sitting thereon.

Embodiments of the chair may further include a cross member comprising an upward facing concave edge, the concave edge comprising a portion of a spherical profile, the cross member configured to mate with the frontal aspects of the two sidepieces, such mating stabilizing the two sidepieces in the open position. When the frame is in an open arrangement, more particularly, when opened to a working chair angle, and when the cross member is in place and mated with the frontal aspects of the sidepieces, the upward-facing concave edges of the two sidepieces and the cross bar collectively form a three-strut triangular seating ball cradle to accommodate a seating ball. Further, in this arrangement, the holes in the upper region of each sidepiece collectively form a lumbar support ball cradle to accommodate a lumbar support ball.

The collapsed arrangement of a chair is appropriate for storing the chair in a low volume profile form. An embodiment of a chair in this collapsed arrangement occupies a minimal amount of space in an open room or in a storage compartment or closet. A chair in this collapsed chair arrangement is also amenable to being placed in a substantially flat box for storage or shipping. The open arrangement, particularly when stabilized by a cross member at a working angle, is the chair arrangement appropriate for use by a subject sitting on the chair.

Arranging embodiments of the chair from a collapsed or storage arrangement into an assembled ready-to-use arrangement is simple and requires no tools. Some embodiments of the chair, as in a fully assembled form, include a seating ball disposed within the cradle. In typical embodiments, the seating ball cradle and the seating ball are sized and configured relative to each other such that the seating ball can be freely placed in the cradle and freely removed from the cradle. Embodiments of the cradle that supports the seating ball include, as noted above, the concave edges of the two sidepieces and the cross-sectional surface of the cross bar. Each of the surfaces that contact the seating ball is curved to form an arc that fits the spherical surface of the seating ball. These surfaces may be understood as forming a triangle from either a top or bottom view, more particularly an isosceles triangle with its acute vertex form at the hinged back surfaces of the sidepieces.

Some embodiments of the chair, as in a fully assembled form, further include a lumbar support ball disposed within the lumbar ball nesting site. In some embodiments of the chair, the site defined by holes in the upper region of the each sidepiece is configured such that the ball can be positioned in the nesting site at a range of heights. In some embodiments of the chair, the lumbar ball nesting site and the lumbar support ball are sized and configured relative to each other such that the lumbar ball, when disposed within the lumbar ball nesting site, is secured by a compression fitting of the ball within the boundaries of the nesting site, as defined by the inner edges of the holes in the upper aspect of the chair sidepieces. Because of this relationship between the size of the nesting site and the lumbar support ball, one method of assembling the chair with the lumbar support ball disposed within its nesting site is to open the chair wider than its operating stance or angle, hold the ball between the sidepiece holes, and then close the sidepieces around the ball to bring the sidepieces to a working chair angle such that the front aspects of the sidepieces can be fitted with the cross member. As the chair sidepieces close to a working angle, the lumbar support ball is secured within its seating site.

The position of the lumbar support ball, as provided by embodiments of the chair, contributes to an adjustable aspect of the ergonomic benefit for a seated subject. The lumbar support ball can be placed at a range of elevation above the seating ball, as noted above. This elevation of the ball can be adjusted up or down manually within the nesting site to provide lumbar support for seated subjects of varied heights, or for their individual preference.

In terms of the relative front to back position of the lumbar support ball with respect to the seating ball, the lumbar support ball, as disposed in its nesting site, is positioned sufficiently forward with respect to the seating ball that the lumbar support encourages a posture whereby the sitter's spine assumes a neutral position. Further, the lumbar support ball, as disposed in the nesting site, is positioned such that the spine of a subject sitting on the ball with his or her spine into a neutral position receives support from the lumbar support ball. Still further with regard to the front-to-back position of the lumbar support ball within its nested position, the relative size and position of the ball and the configuration of the upper region of the sidepieces are such that the back of a subject sitting on the chair typically contacts only the ball, not the edges of the upper portion of the sidepieces of the chair.

In some embodiments of the chair, each of the frontal aspects of the sidepieces includes a cross member mating element and the cross member includes a sidepiece mating element at each of its two ends, the cross member mating elements and the cross member sidepiece mating elements being mutually compatible. Embodiments of the chair may further include a locking element configured to secure each of the two mated joinings or joining sites of the cross member with the chair sidepieces. In some embodiments, the locking element comprises a peg or a pin in a hole; and in some these embodiments, the peg is wedge shaped such that it can be tightly fitted into its mating element. This locking configuration is quickly and easily manipulated, with regard both to locking and unlocking. Locking the sidepieces and the cross member together substantially stabilizes the chair in a working position.

In some embodiments of the chair, the collapsible frame, when collapsed, can assume a substantially flat two dimensional form, the internal faces of the two chair sidepieces lying parallel against each other, the external faces facing externally. In some embodiments of the chair, the collapsible frame, can assume a fully open arrangement, the two chair sidepieces lying side by side, their respective joined back edges proximate each other, such that they are coplanar across their common hinged attachment sites. In some embodiments of the chair, the collapsible frame, can assume a working chair angle such that the mating elements of the respective front edge of the base portion of the side pieces correspond to the distance between the mating elements on the cross piece.

Some embodiments of the chair further include one or more floor mobility elements, such as casters, affixed to a lower edge of the base portion. Mobility elements provide advantages when embodiments of the chair are being used in a working environment, such as with a user working at a desk. Embodiments of the chair may be fabricated from any suitable materials, however particular embodiments are formed from wood.

DETAILED DESCRIPTION OF THE INVENTION

Figure 1B:
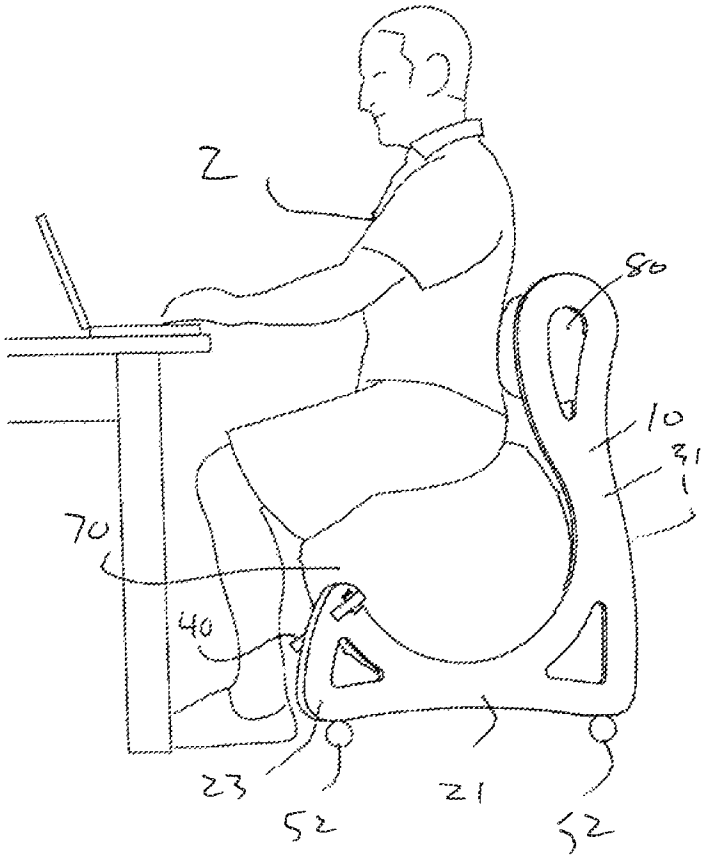
FIG. 1B shows a subject sitting in an embodiment of the chair while working at a desk, this embodiment of the chair having floor mobility elements attached to the base of the chair.
Figure 1A:
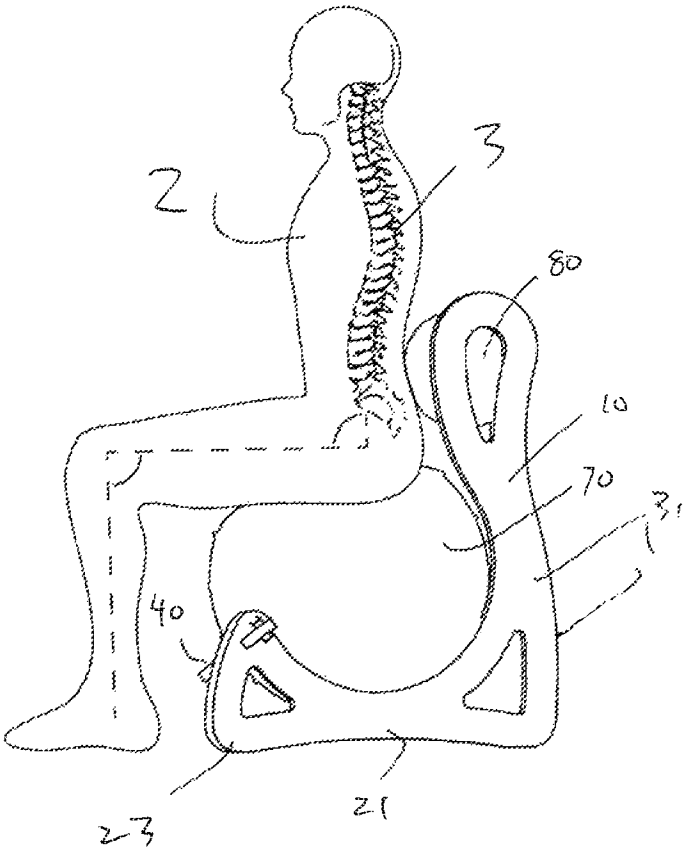
FIG. 1A shows a side view of a subject sitting in an embodiment of the chair, the subject's spine in a neutral position, as encouraged and supported by the chair.
Figure 1C:
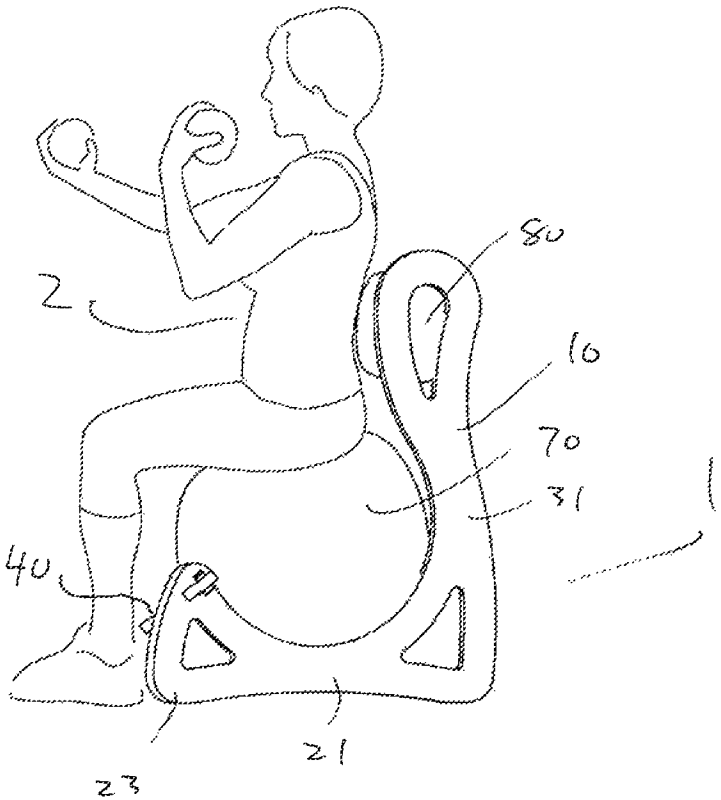
FIG. 1C shows a subject sitting in an embodiment of the chair while performing an exercise.

FIGS. 1A-1C provide various views of a subject 2 seated on an embodiment of the disclosed collapsible chair 1. The major elements of chair 1 seen in these views include one of the two sidepieces 10, a seating ball 70, and a lumbar support ball 80. Sidepieces 10 each have an internal face 12 (not seen in these views) and an external face 14. Each sidepiece has a substantially horizontal base portion 21 and a substantially vertical back portion 31. The horizontal and back portions are typically formed integrally as a single piece of wood or other appropriate material. A small section of a cross member piece 40 is also seen in these views; better views of the cross member are seen in figures as described further below.

The upper region of the back portion 31 of sidepiece 10 includes a wedge-shaped hole 36 that is configured to hold lumbar support ball 80 in place when the chair is in an open position.

Figure 2:
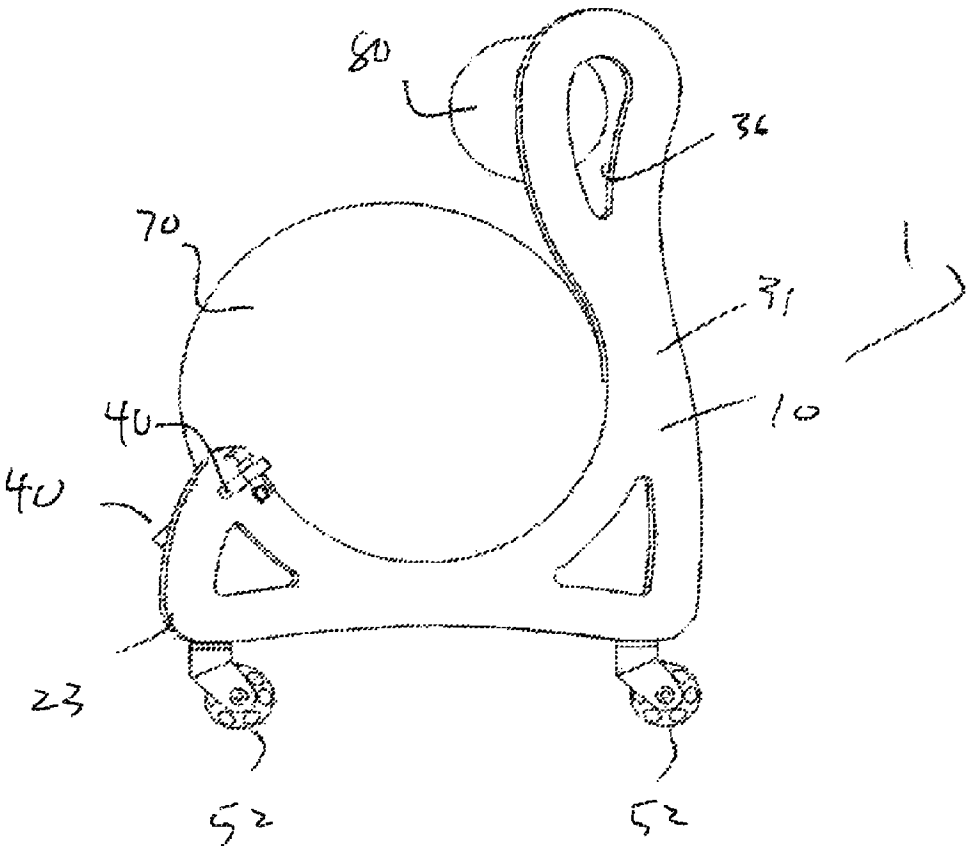
FIG. 2 shows a side view of an embodiment of the chair that has mobility elements affixed to the base portion of the chair.

FIG. 1A shows a side view of the subject sitting in an embodiment of the chair; the subject is rendered partially transparent in order to depict the subject's spine 3. The spine is in a neutral position, as so encouraged and supported by embodiments of the chair. FIG. 1B shows the subject 2 sitting in an embodiment of the chair while working at a desk, this embodiment of the chair is shown with floor mobility elements 52, such as casters, attached to the base of the chair. FIG. 2 provides a detailed view of mobility elements. FIG. 1C shows a subject sitting in an embodiment of the chair while performing an exercise.

FIG. 2 shows a side view of an embodiment of chair 1 that has mobility elements 52 affixed to the base portion of the chair. Mobility elements 52 may be of any conventional type; those shown have a 360-degree swivel capability.

Figure 3B:
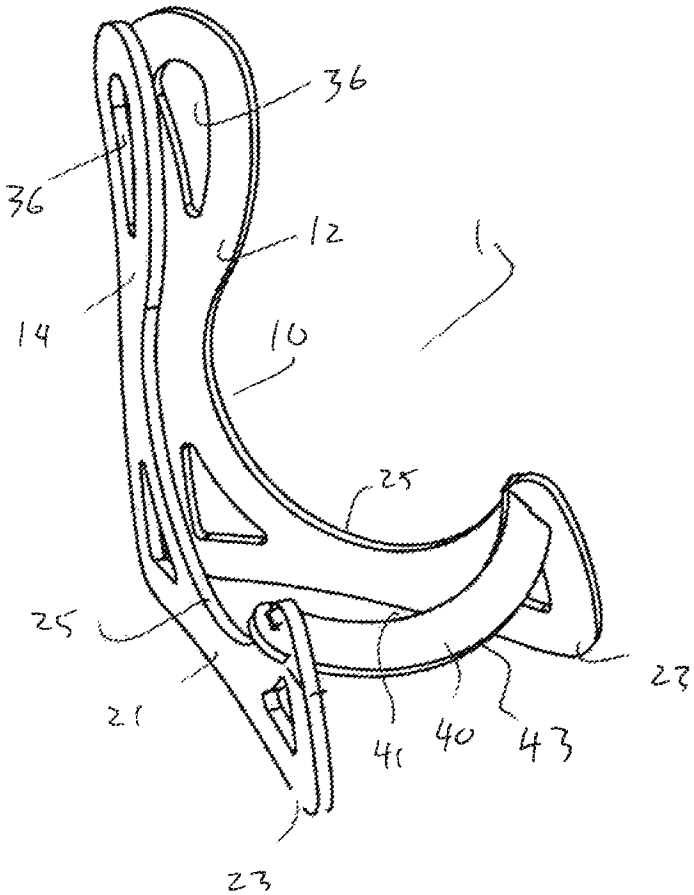
FIG. 3B shows a perspective view of an embodiment of the chair in an open arrangement absent the seating ball and the lumbar support ball.
Figure 3A:
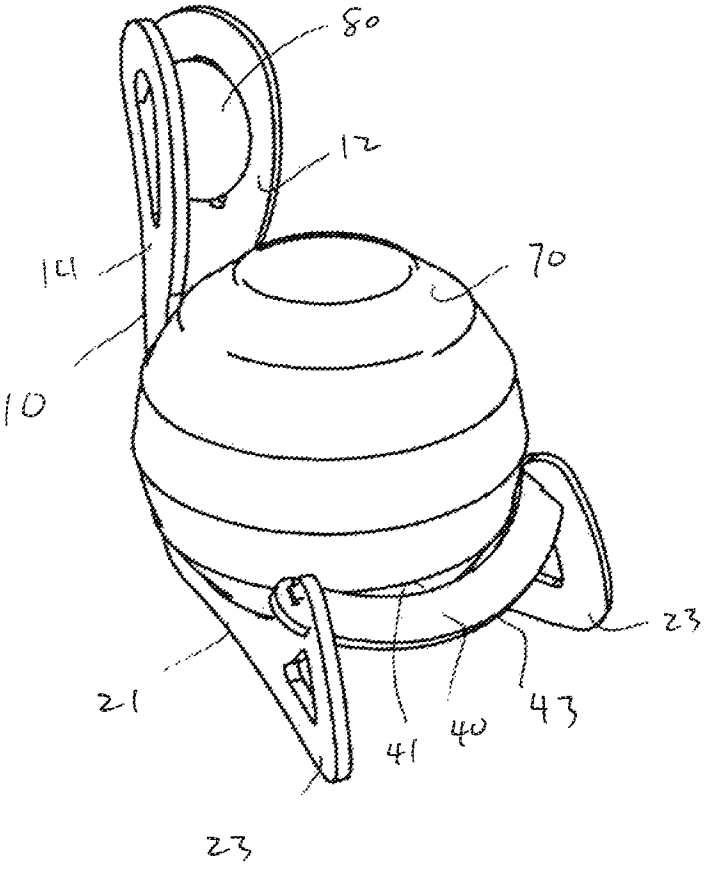
FIG. 3A shows a perspective view of an embodiment of the chair in an open arrangement with a seating ball and a lumbar support ball in place.

FIGS. 3A and 3B show perspective views of an embodiment of chair 1 in an open arrangement. FIG. 3A shows the chair embodiment with a seating ball 70 and a lumbar support ball 80 in place. FIG. 3B shows the chair embodiment, alone, without the seating ball and lumbar support ball in place. Several features of chair 1 that are not visible in FIGS. 1A-1C and 2 are visible in these views. The perspective view affords visibility to both the internal faces 12 and external faces 14 of sidepieces 10. Cross member 40 is shown in place, arranged between and connecting the front edges 23 of base portion 21 of sidepieces 10.

Figure 4B:
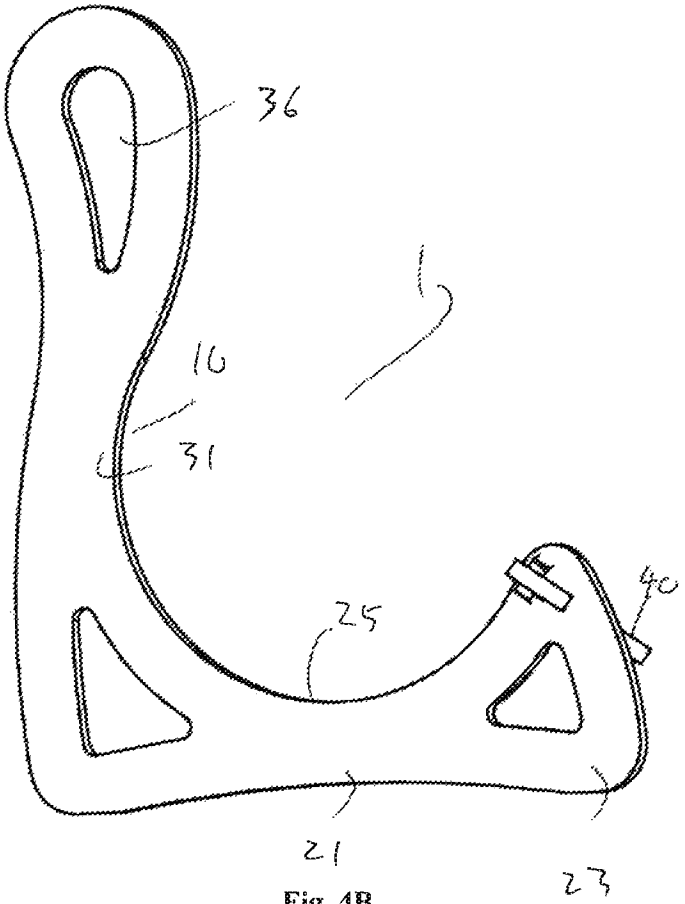
FIG. 4B shows a side view of an embodiment of the chair in an open arrangement absent the seating ball and the lumbar support ball.
Figure 4A:
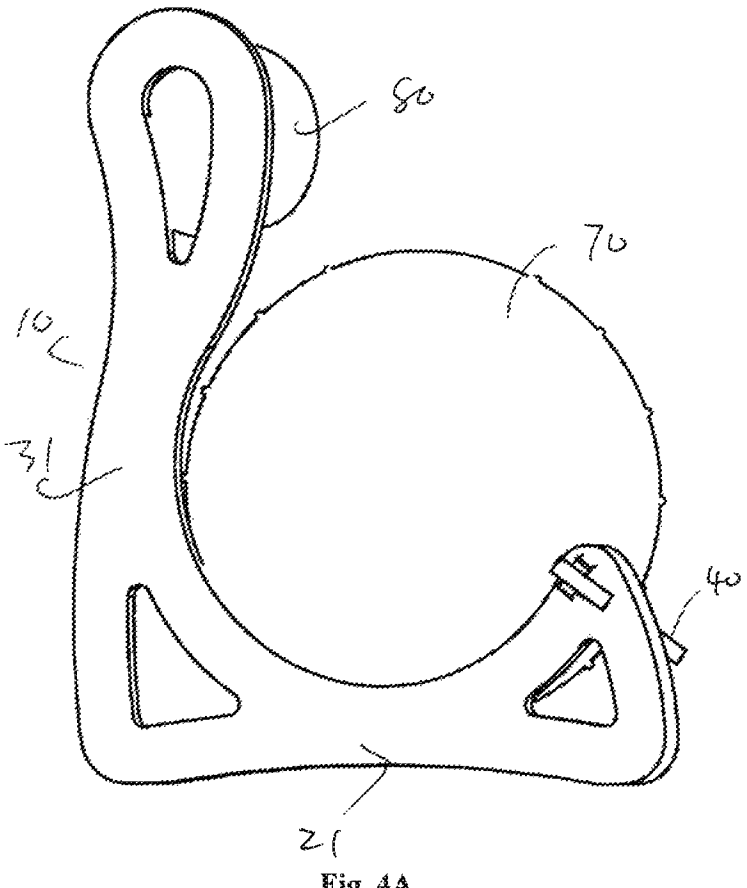
FIG. 4A shows a side view of an embodiment of the chair in an open arrangement with a seating ball and a lumbar support ball in place.

FIGS. 4A and 4B show side views of an embodiment of chair 1 in an open arrangement. FIG. 4A shows the chair embodiment with a seating ball 70 and a lumbar support ball 80 in place. FIG. 4B shows the chair embodiment, alone, without the seating ball and lumbar support ball in place.

Figure 5B:
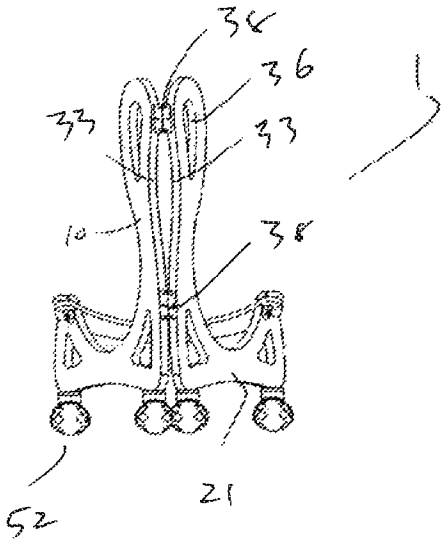
FIG. 5B shows a back view of an embodiment of the chair in an open arrangement absent the seating ball and the lumbar support ball.
Figure 5A:
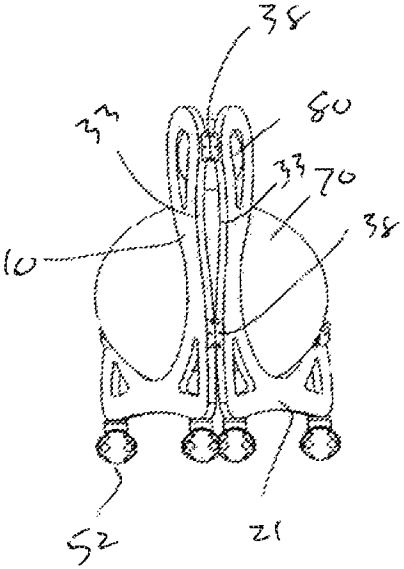
FIG. 5A shows a back view of an embodiment of the chair in an open arrangement with a seating ball and a lumbar support ball in place.

FIGS. 5A and 5B show rear views (forward-looking views) of an embodiment of chair 1 in an open arrangement. FIG. 5A shows the chair embodiment with a seating ball 70 and a lumbar support ball 80 in place. FIG. 5B shows the chair embodiment, alone, without the seating ball and lumbar support ball in place. These views show hinge elements 38 arranged on the upper and lower region of back edge 33 of sidepieces 10.

Figure 6B:
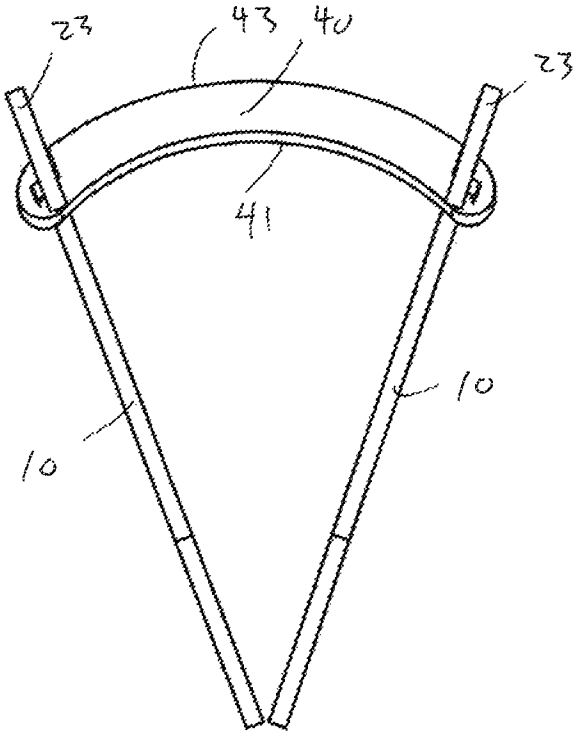
FIG. 6B shows a top view of an embodiment of the chair in an open arrangement absent the seating ball and the lumbar support ball.
Figure 6A:
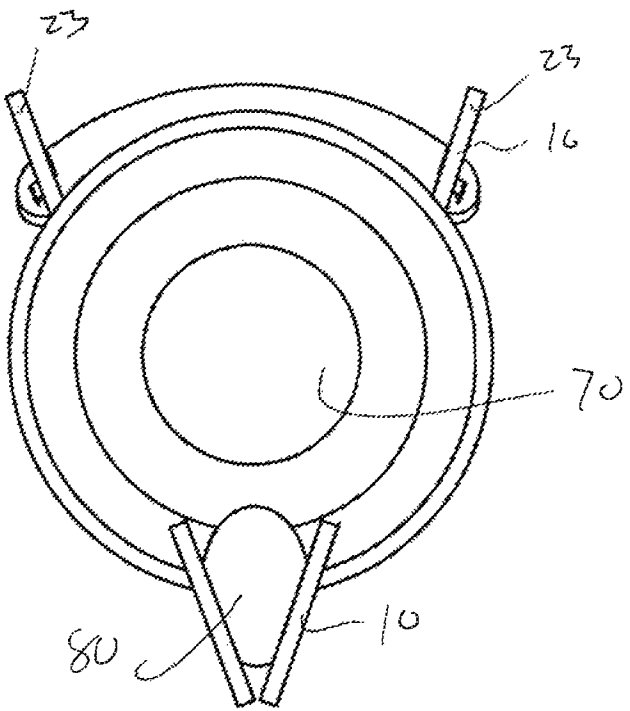
FIG. 6A shows a top view of an embodiment of the chair in an open arrangement with a seating ball and a lumbar support ball in place.
Figure 7B:
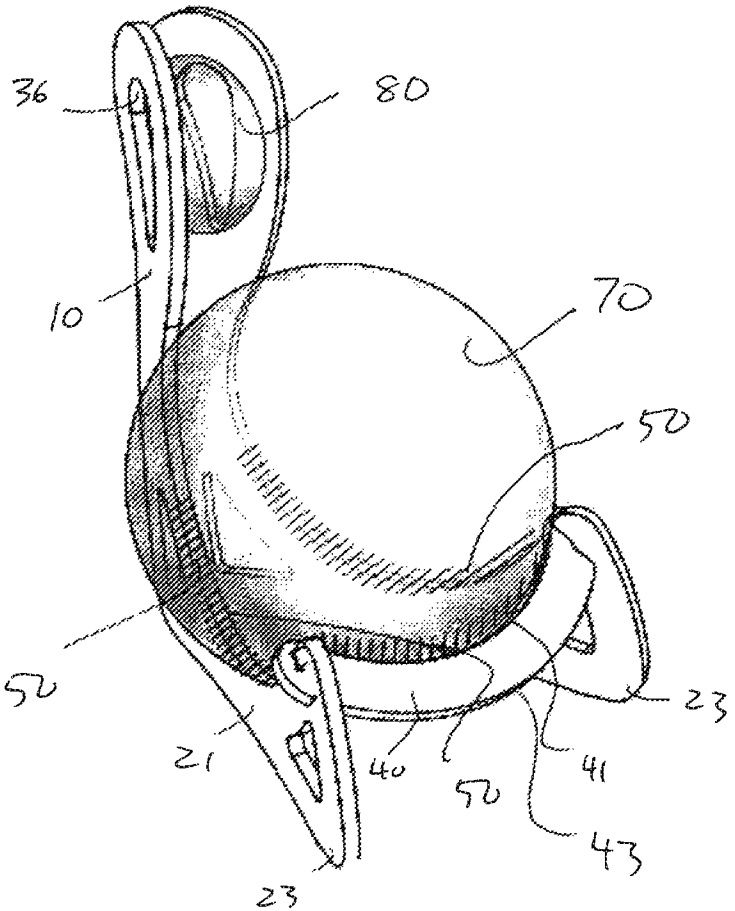
FIG. 7B shows a perspective view of a triangular cradle for the seating ball.
Figure 7A:
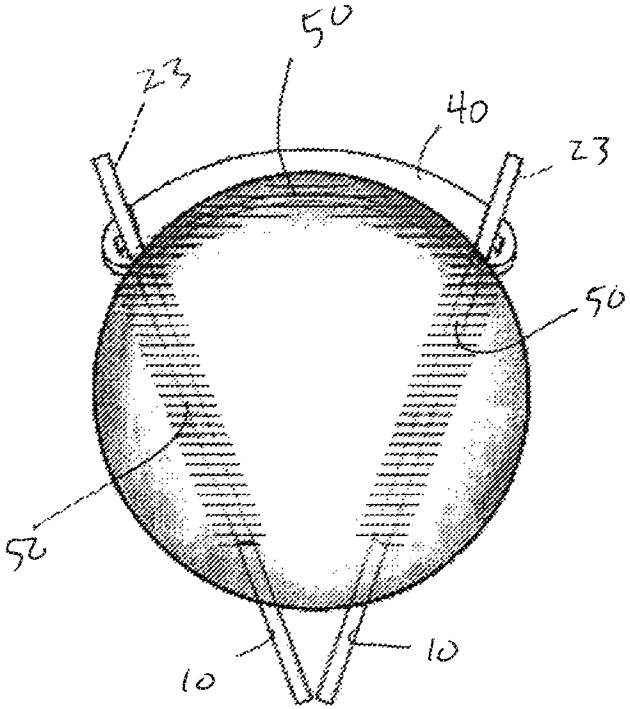
FIG. 7A shows a top view of a triangular cradle for the seating ball.

FIGS. 6A and 6B show top views (downward-looking views) of an embodiment of chair 1 in an open arrangement. FIG. 6A shows the chair embodiment with a seating ball 70 and a lumbar support ball 80 in place. FIG. 6B shows the chair embodiment, alone, without the seating ball and lumbar support ball in place. These figures provide a view of how sidepieces 10 and cross member 40 form a supportive cradle that holds seating ball 70. In this top view, the three members (cross member and sidepieces) have a triangular appearance; FIGS. 7A and 7B provide a more three-dimensional view.

FIGS. 7A and 7B show views of an embodiment of chair 1 in an open arrangement with the seating ball 70 rendered transparently in order to depict the three lines of contact between the seating ball and the portion of the chair that forms a supportive triangular cradle for the ball. FIG. 7A shows a top of the chair embodiment with a seating ball and in place (lumbar support ball not shown). FIG. 7*b* shows a perspective view of the chair embodiment with a seating ball and the lumbar support balls in place. FIG. 7A is similar to the top views of FIGS. 6A and 6B, but the points of contact between the three chair members (the upward facing concave edge of cross member 40 and the upper edges of sidepieces 10 which can be collectively understood as three support struts) are emphasized with railroad track tie markings for visual emphasis. These marked regions, identifying the strut members, collectively represent triangular cradle 50, which supports the seating ball 70. Cradle 50 is formed from three struts that define a spherical form that is complementary to the sphere of seating ball 70. Seating ball 70 can be freely dropped into place within cradle 50, and freely lifted therefrom. The curved surfaces of the cradle cannot be clearly seen in FIGS. 7A and 7B because of the intervening presence of seating ball 70, but the component surfaces (upper edge 25 of each sidepiece 10 and upper edge 41 of cross member piece 40 are plainly visible in FIG. 8.

Figure 8:
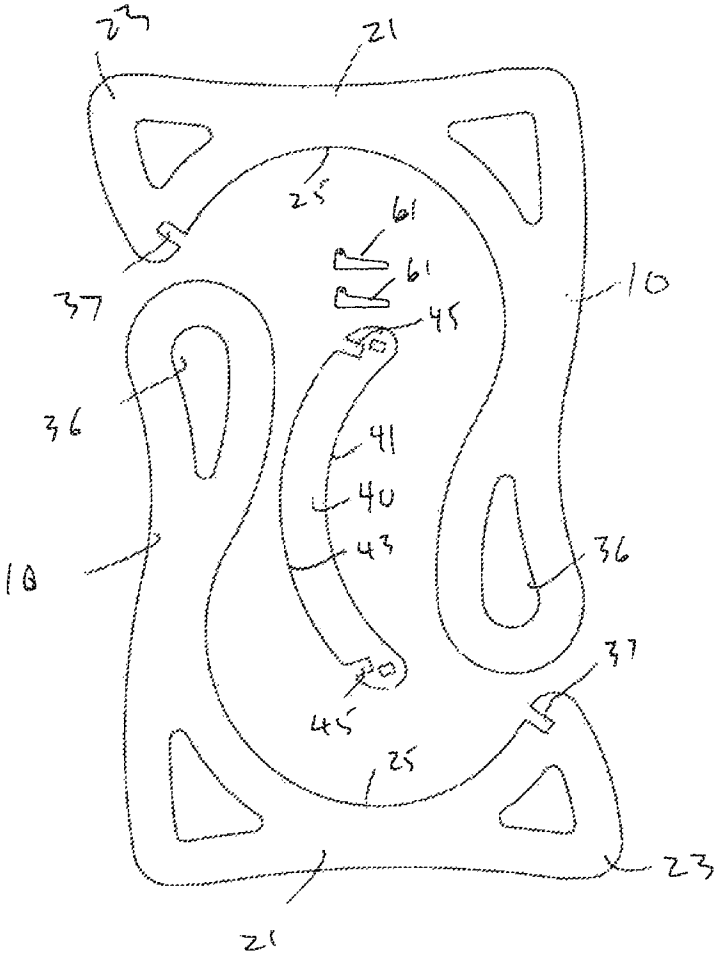
FIG. 8 shows a flat view of each of pieces of the chair.

Continuing with reference to FIG. 8, this figure shows a flat view of each of the major pieces of an embodiment of chair 1, as in a disassembled state, or in a state appropriate for shipping. This view emphasizes the simplicity of the chair 1, which includes three major structural components, the sidepieces 10 and cross member 40. Also shown are fastening or fixation elements 61. This view of sidepieces and cross member also shows the complementary mating feature 37 of sidepiece 10 and mating feature 45 of cross member piece 40.

Figure 9B:
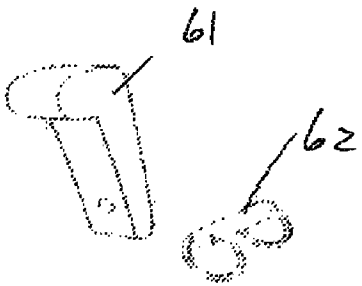
FIG. 9B shows a detail view of a wedge and a locking pin that together comprise an embodiment of a fixation element.
Figure 9A:
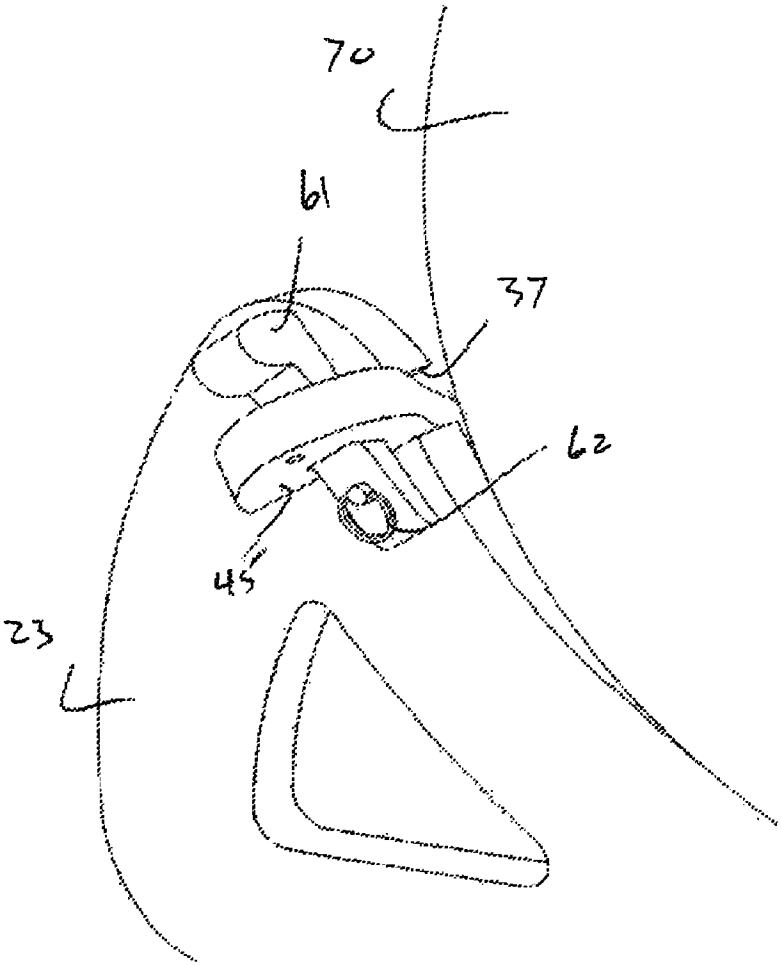
FIG. 9A shows a detailed view of an embodiment of the chair, focusing on a fixation element that stabilizes the connection of a cross member and the front edge of the base portion of a sidepiece when the chair is assembled.

FIG. 9A shows a detailed view of an embodiment of chair 1, focusing on a wedge-shaped fixation element 61 that stabilizes the connection of a cross member and the front edge of the base portion of a sidepiece when the chair is assembled. FIG. 9B shows a detail view of a wedge 61 and a locking insert pin 62 that together comprise an embodiment of a fixation element. Elements 61 and 62 stabilize the fixation of mating feature 37 of sidepiece 10 and mating feature 45 of cross member piece 40.

Figure 10:
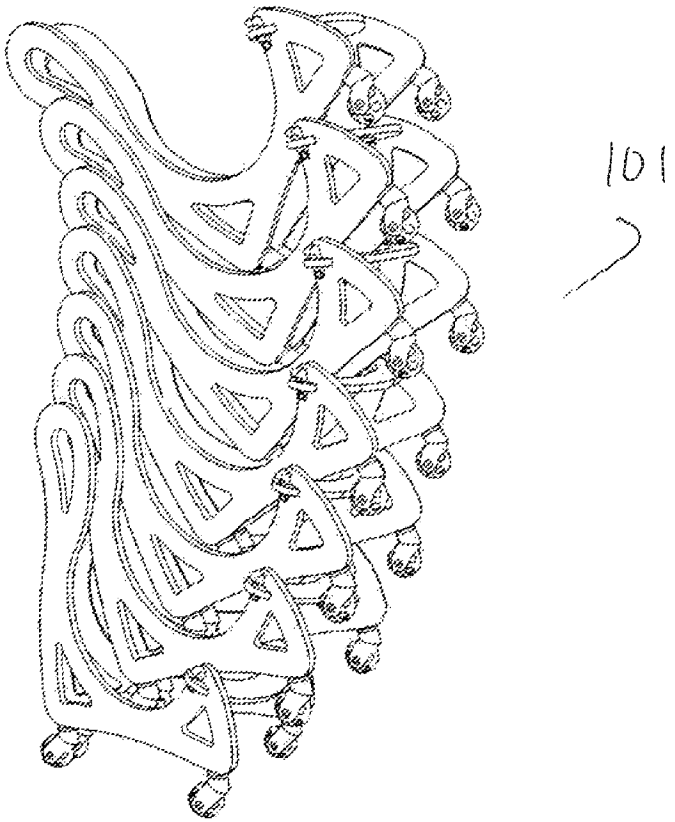
FIG. 10 shows a stacked series of chairs, the chairs in an open or working position.

FIG. 10 shows a stack 101 of seven chairs, each of the chairs being in an open configuration. Embodiments of the chair in an open position are stackable, when assembled and without the seating and lumbar balls in place, in a manner that conserves space. Embodiments of the chair are collapsible, and when collapsed or folded into a closed position, can be stored in a vertical stack or side-by-side in a very space-efficient manner However, in some instances, it may be most convenient or quick to simply remove the seating ball from a group of chairs and stack them vertically, without collapsing them. This vertically stackable aspect of embodiments of the chair provides a highly efficient as a way to minimize occupied floor space and total occupied volume. For example, using the dimensions of an embodiment of a chair, as just described, a single assembled chair has a height of approximately 35 inches. A second assembled chair, when stacked within the first chair, adds approximately 6.2 inches in height to the final height of the two stacked chairs. Thus, each chair, when stacked, increases the height of the stack by about 17.6% of the height of a single chair.

EXAMPLE OF AN EMBODIMENT

Dimensions of an example of an embodiment of a collapsible ergonomic chair per the disclosed technology will now be provided. The sidepieces of this particular embodiment have a height along their back portion of about 33.2 in, and a base portion horizontal length of about 27.5 in. Embodiments of the chair that are fitted with floor mobility elements, such as casters, have an overall height that is elevated beyond the 33.2 inch height by about 1 to about 3 inches, depending on the particular dimensions of the casters and the configuration of their attachment to the lower aspect of the base portions of the sidepieces.

When the chair embodiment is assembled and placed into an open working arrangement with the side pieces joined by a cross member, the side pieces are open at angle of about 40 degrees, the vertex being represented by the side pieces joined along their back edges at hinged sites. This angle of 40 degrees is the most acute angle of an isosceles triangle. The other two angles, at the junctions of the sidepieces and the cross member, are of about 70 degrees.

When a cross member is mated to the two sidepieces in an assembled arrangement of the chair, the cross member is positioned at an angle of about 37 degrees with respect to the horizontal.

The seating ball, when inflated to a normal pressure, has a diameter of about 22.2 in. The lumbar support ball, when inflated to a normal pressure, has a diameter of about 7.6 in.

What is claimed is:

1. A chair comprising:

a collapsible frame comprising two chair sidepieces, each sidepiece having an internal face and an external face, each sidepiece comprising:

a base portion comprising an upward facing edge for contacting a portion of a profile of a seating ball, the base portion further comprising a frontal aspect, a back portion comprising a back edge and a hole in its upper region, and one or more hinge attachment sites positioned to connect the two sidepieces at their respective back edges, the sidepieces, when connected by hinges at the one or more attachment sites, being moveable between a collapsed arrangement and an open arrangement; and a cross member comprising an upward facing edge complementary to a portion of the profile of the seating ball, the cross member configured to mate with the frontal aspects of the two sidepieces, such mating stabilizing the two sidepieces in the open position, wherein when the frame is in an open arrangement and when the cross member is in place and mated with the frontal aspects of the sidepieces, the upward facing edges of the two sidepieces and the cross bar collectively form a three-strut seating ball cradle to accommodate the seating ball, and the holes in the upper region of each sidepiece collectively form a lumbar support ball nesting site.

2. The chair of claim 1, wherein the cradle defines a portion of a surface complementary to the dimension of the seating ball.

3. The chair of claim 1, further comprising the seating ball disposed within the seating ball cradle.

4. The chair of claim 3 wherein the seating ball cradle and the seating ball are sized and configured relative to each other such that the seating ball can be freely placed in the cradle and freely removed from the cradle.

5. The chair of claim 1, further comprising a lumbar support ball disposed within the lumbar support ball nesting site.

6. The chair of claim 5, wherein the site defined by holes in the upper region of the each sidepiece is configured such that the lumbar support ball can be positioned in the nesting site at a range of heights.

7. The chair of claim 5, wherein the lumbar ball nesting site and the lumbar support ball are sized and configured relative to each other such that the lumbar ball, when disposed within the lumbar ball nesting site, is secured by a compression fit.

8. The chair of claim 5, wherein the lumbar support ball, as disposed in the lumbar support ball nesting site, is positioned relative to a top center point of the seating ball such that a subject sitting on the ball with body weight substantially balanced around the top center point is urged by the lumbar support ball to maintain his or her spine into a neutral position.

9. The chair of claim 5, wherein the seating ball disposed in the nesting site is positioned such that the spine of a subject sitting on the ball with his or her spine into a neutral position receives support from the lumbar support ball.

10. The chair of claim 5, wherein the seating ball, as disposed in the nesting site, is positioned such that the back of a subject sitting on the ball with his or her spine into a neutral position contacts the lumbar support ball without contacting an edge of the chair sidepieces.

11. The chair of claim 1, wherein each of the frontal aspects of the sidepieces comprises a cross member mating element and wherein the cross member comprises a sidepiece mating element at each of its two ends, the cross member mating elements and the cross member sidepiece mating elements being mutually compatible.

12. The chair of claim 11, further comprising a locking element configured to secure each of the two mated joinings of the cross member with the chair sidepieces.

13. The chair of claim 12, wherein the locking element comprises a peg in a hole.

14. The chair of claim 12, wherein the peg is wedge shaped.

15. The chair of claim 1, wherein the two chair sidepieces are substantially mirror images of each other.

16. The chair of claim 1, wherein the collapsible frame, when collapsed, can assume a substantially flat two dimensional folded form, the internal faces of the two chair sidepieces lying parallel against each other.

17. The chair of claim 1, wherein the collapsible frame can assume a fully open arrangement, the two chair sidepieces lying side by side, with their respective back edges proximate each other, such that they are coplanar across their common hinged attachment sites.

18. The chair of claim 1, wherein the collapsible frame can assume a working chair angle such that the mating elements of the respective front edge of the base portion of the side pieces correspond to the distance between the mating elements on the cross piece.

19. The chair of claim 1, further comprising hinge elements attached to corresponding hinge attachment sites on each of the respective chair sidepieces, the sidepieces thereby being connected together at their back edges.

20. The chair of claim 1, further comprising one or more floor mobility elements affixed to a lower edge of the base portion.

* * * * *